US011842678B2

(12) United States Patent
Wen et al.

(10) Patent No.: US 11,842,678 B2
(45) Date of Patent: Dec. 12, 2023

(54) HIGH-BRIGHTNESS MODE ON AN OLED DISPLAY

(71) Applicant: Google LLC, Mountain View, CA (US)

(72) Inventors: Chien-Hui Wen, Cupertino, CA (US); Sang Young Youn, Cupertino, CA (US)

(73) Assignee: Google LLC, Mountain View, CA (US)

( * ) Notice: Subject to any disclaimer, the term of this patent is extended or adjusted under 35 U.S.C. 154(b) by 12 days.

(21) Appl. No.: 17/500,811

(22) Filed: Oct. 13, 2021

(65) Prior Publication Data

US 2022/0044629 A1 Feb. 10, 2022

Related U.S. Application Data

(60) Provisional application No. 63/254,934, filed on Oct. 12, 2021.

(51) Int. Cl.
*G09G 3/3208* (2016.01)

(52) U.S. Cl.
CPC ... *G09G 3/3208* (2013.01); *G09G 2320/0276* (2013.01); *G09G 2320/0633* (2013.01)

(58) Field of Classification Search
CPC ..... G09G 3/3208
See application file for complete search history.

(56) References Cited

U.S. PATENT DOCUMENTS 5,491,568 A 2/1996 Wan
6,954,193 B1 10/2005 Andrade et al.
7,123,223 B2 10/2006 Moon
7,126,611 B1 10/2006 Weed
7,697,165 B2 4/2010 Osaki et al.
7,728,845 B2 6/2010 Holub
7,844,109 B2 11/2010 Matsuura
7,940,434 B2 5/2011 Inoue
(Continued)

FOREIGN PATENT DOCUMENTS

CN 109981839 7/2019
CN 111241890 6/2020
(Continued)

OTHER PUBLICATIONS

"International Preliminary Report on Patentability", Application No. PCT/US2019/065677, dated May 17, 2022, 18 pages.
(Continued)

*Primary Examiner* — William Boddie
*Assistant Examiner* — Andrew B Schnirel
(74) *Attorney, Agent, or Firm* — Colby Nipper PLLC

(57) ABSTRACT

This document describes techniques and apparatuses for a high-brightness mode on an organic light emitting diode (OLED) display. The techniques and apparatuses set a high-brightness value in a register of a display driver integrated circuit (DDIC) associated with the OLED display of on electronic device. A processor of the electronic device provides a fewer-pulses command to the DDIC, which adjusts a pulse number to control the OLED display at fewer pulses per period. A gamma correction is determined based on the high-brightness value and used to alter content to be presented on the OLED display. As a result, fewer pulses are used in combination with the gamma correction to provide content on the OLED display at a high brightness.

20 Claims, 5 Drawing Sheets

(56) References Cited

U.S. PATENT DOCUMENTS

| | | | | |
|---|---|---|---|---|
| 8,045,796 | B2 | 10/2011 | Matsuoka et al. | |
| 8,441,691 | B2 | 5/2013 | Mestha et al. | |
| 8,638,340 | B2 | 1/2014 | Holub | |
| 8,870,393 | B2 | 10/2014 | Kawahara | |
| 9,299,282 | B2 | 3/2016 | Oh et al. | |
| 9,697,758 | B2 | 7/2017 | Watanabe et al. | |
| 9,754,522 | B2 | 9/2017 | Park et al. | |
| 9,858,640 | B1 | 1/2018 | Earl et al. | |
| 9,933,887 | B2 | 4/2018 | Choi | |
| 10,068,551 | B1 | 9/2018 | Choi et al. | |
| 10,424,269 | B2 | 9/2019 | Chen et al. | |
| 10,453,423 | B2 | 10/2019 | Nasiriavanaki et al. | |
| 10,510,317 | B2 | 12/2019 | Spence et al. | |
| 10,885,852 | B2 | 1/2021 | Zhang et al. | |
| 11,163,970 | B1 | 11/2021 | Sammoura et al. | |
| 11,403,984 | B2 | 8/2022 | Jung et al. | |
| 2002/0050958 | A1 | 5/2002 | Matthies et al. | |
| 2004/0001076 | A1 | 1/2004 | Leng et al. | |
| 2006/0204083 | A1 | 9/2006 | Takahashi | |
| 2009/0303161 | A1* | 12/2009 | Messmer | G09G 3/2011 345/55 |
| 2010/0060667 | A1 | 3/2010 | Chen et al. | |
| 2010/0207860 | A1 | 8/2010 | Chang et al. | |
| 2010/0302268 | A1* | 12/2010 | Jun | G09G 5/02 345/589 |
| 2012/0013635 | A1 | 1/2012 | Beeman et al. | |
| 2012/0147291 | A1 | 6/2012 | Seo | |
| 2013/0342519 | A1 | 12/2013 | Kim et al. | |
| 2014/0009408 | A1 | 1/2014 | Lee | |
| 2014/0092061 | A1 | 4/2014 | Akai et al. | |
| 2014/0292628 | A1 | 10/2014 | Park | |
| 2015/0287352 | A1* | 10/2015 | Watanabe | G09G 3/3648 345/89 |
| 2016/0063933 | A1 | 3/2016 | Kobayashi et al. | |
| 2016/0078838 | A1 | 3/2016 | Huang et al. | |
| 2016/0078846 | A1 | 3/2016 | Liu et al. | |
| 2016/0210907 | A1 | 7/2016 | Hsieh et al. | |
| 2016/0210923 | A1 | 7/2016 | Yoshida et al. | |
| 2017/0004760 | A1 | 1/2017 | Jang et al. | |
| 2017/0062547 | A1 | 3/2017 | Mathew et al. | |
| 2017/0092196 | A1 | 3/2017 | Gupta et al. | |
| 2017/0147865 | A1 | 5/2017 | Jensen et al. | |
| 2017/0344846 | A1 | 11/2017 | Yoshida | |
| 2018/0121703 | A1 | 5/2018 | Jung et al. | |
| 2018/0151109 | A1 | 5/2018 | Shim et al. | |
| 2018/0199014 | A1 | 7/2018 | Morgan et al. | |
| 2018/0268780 | A1* | 9/2018 | Bae | G09G 5/026 |
| 2018/0277051 | A1 | 9/2018 | Du | |
| 2018/0293419 | A1 | 10/2018 | Yan | |
| 2018/0301080 | A1 | 10/2018 | Shigeta et al. | |
| 2019/0027082 | A1 | 1/2019 | Belle | |
| 2019/0147832 | A1 | 5/2019 | Kim et al. | |
| 2019/0180691 | A1 | 6/2019 | Takasugi | |
| 2019/0228740 | A1 | 7/2019 | Aflatooni et al. | |
| 2020/0066236 | A1 | 2/2020 | Giusti et al. | |
| 2020/0273427 | A1 | 8/2020 | Wang | |
| 2020/0273919 | A1 | 8/2020 | Ding et al. | |
| 2020/0312231 | A1 | 10/2020 | Hussell | |
| 2020/0402478 | A1 | 12/2020 | Her et al. | |
| 2021/0012749 | A1 | 1/2021 | Furihata et al. | |
| 2021/0049966 | A1 | 2/2021 | Hsu et al. | |
| 2021/0183290 | A1* | 6/2021 | Sato | G09G 3/20 |
| 2021/0201731 | A1 | 7/2021 | Ranjan et al. | |
| 2021/0201738 | A1* | 7/2021 | Song | G09G 3/20 |
| 2021/0408140 | A1 | 12/2021 | Han et al. | |
| 2022/0114956 | A1* | 4/2022 | Lee | G09G 3/20 |
| 2022/0130308 | A1 | 4/2022 | Jung et al. | |
| 2022/0223076 | A1 | 7/2022 | Agahian et al. | |
| 2023/0139382 | A1 | 5/2023 | Sammoura et al. | |

FOREIGN PATENT DOCUMENTS

| | | |
|---|---|---|
| CN | 111477135 | 7/2020 |
| CN | 112331145 | 2/2021 |
| CN | 113053306 | 6/2021 |
| JP | 2013106347 | 5/2013 |
| KR | 20060124209 | 12/2006 |
| KR | 20120120098 | 11/2012 |
| KR | 102279278 | 7/2016 |
| KR | 20160080768 | 7/2016 |
| KR | 20210004007 | 1/2021 |
| WO | 20090152526 | 12/2009 |
| WO | 2021118556 | 6/2021 |
| WO | 2022105484 | 5/2022 |
| WO | 2022186863 | 9/2022 |

OTHER PUBLICATIONS

"International Search Report and Written Opinion", Application No. PCT/US2019/065677, dated May 26, 2020, 25 pages.

Agahian, et al., "Clustering-Based Display Calibration", Technical Disclosure Commons, https://www.tdcommons.org/dpubs_series/5611, Jan. 2, 2023, 7 pages.

Choi, "Clock Trace Structure for Block Sequential Clock Driving", Technical Disclosure Commons, https://www.tdcommons.org/dpubs_series/4786, Dec. 19, 2021, 11 pages.

Choi, et al., "Dynamically Altering Clock Signal Frequencies in LTPO AMOLED Displays", Technical Disclosure Commons, https://www.tdcommons.org/dpubs_series/4652, Oct. 12, 2021, 11 pages.

Choi, et al., "Expediting Fingerprint Authentication by Compensating for Display Luminance Latency", Technical Disclosure Commons, https://www.tdcommons.org/dpubs_series/4686, Oct. 29, 2021, 11 pages.

Choi, et al., "Readability Enhancements for Device Displays used in BrightReadability Enhancements for Device Displays used in BrightLighting Conditions", Technical Disclosure Commons—https://www.tdcommons.org/dpubs_series/3871, Dec. 10, 2020, 9 pages.

Colantoni, et al., "High-End Colorimetric Display Characterization Using an Adaptive Training Set", Society for Information Display, Aug. 2011, 11 pages.

Dianat, et al., "Dynamic Optimization Algorithm for Generating Inverse Printer Map with Reduced Measurements", Published in the proceedings of IEEE Int. Conference on Acoustics, Speech, and Signal Processing, May 2006, 5 pages.

Eiriksson, et al., "Predicting Color Output of Additive Manufactured Parts", Proceedings of Achieving Precision Tolerances in Additive Manufacturing: ASPE Spring Topical Meeting, Jan. 1, 2015, 6 pages.

Karri, et al., "User Interface Mitigation of Display Artifacts During Transitions between Display Clock Speeds", Technical Disclosure Commons, https://www.tdcommons.org/dpubs_series/5427, Nov. 4, 2022, 7 pages.

Kim, et al., "Adaptive Display Frequency Control for Power Savings", Technical Disclosure Commons, https://www.tdcommons.org/dpubs_series/5476, Nov. 4, 2022, 12 pages.

Mestha, et al., "Control of Color Imaging Systems: Analysis and Design", Chapter 6.5; Compression of Lookup Tables, Jan. 2009, 14 pages.

Poynton, et al., "Innovations in 3-D Colour LUTs for Display Calibration", https://kb.portrait.com/help/innovations-in-3d-colour-lut-s-for-display-calibration, Jan. 2014, 9 pages.

Poynton, et al., "Innovations in 3D Colour LUT's for Display Calibration", https://kb.portrait.com/help/innovations-in-3d-colour-lut-s-for-display-calibration accessed Aug. 29, 2019, Apr. 2, 2019, 13 pages.

Wen, et al., "Improving Under-Display Fingerprint Authentication Latency by Normalizing Frame Luminance", Technical Disclosure Commons—https://www.tdcommons.org/dpubs_series/5006, Mar. 24, 2022, 12 pages.

Youn, et al., "Image Data Compensation to Prevent Display Artifacts on an OLED Display", Technical Disclosure Commons, https://www.tdcommons.org/dpubs_series/4615, Sep. 23, 2021, 8 pages.

"International Search Report and Written Opinion", Application No. PCT/US2021/057320, dated Feb. 16, 2022, 11 pages.

(56) References Cited

OTHER PUBLICATIONS

Choi, et al., "Disabling Transitions When Encoded Intensity is Low", Application No. PCT/US2021/070522, filed May 10, 2021, 46 pages.
Shin, et al., "Dynamic Voltage Scaling of OLED Displays", Jun. 2011, 6 pages.
Yonebayashi, et al., "High refresh rate and low power consumption AMOLED panel using top-gate n-oxide and p-LTPS TFTs", Mar. 2020, 10 pages.
Wen, et al., "Smooth Brightness Transition for Computing Devices", Technical Disclosure Commons, https://www.tdcommons.org/dpubs_series/3021, Mar. 16, 2020, 9 pages.
"Foreign Office Action", EP Application No. 21811202.7, dated Mar. 17, 2023, 6 pages.
"Non-Final Office Action", U.S. Appl. No. 17/769,193, dated Aug. 15, 2023, 5 pages.

* cited by examiner

400

| | | Baseline 402 | Option 404 | Option 406 |
|---|---|---|---|---|
| EM Pulse Cycle (Normal) 408 | @120 Hz | 3 | 3 | 3 |
| | @60 Hz | 6 | 6 | 6 |
| EM Pulse Cycle (HBM) 410 | @120 Hz | 3 | 1 (0.489 ms) | 1 (0.2445 ms) |
| | @60 Hz | 6 | 2 (0.978 ms) | 1 (0.489 ms) |
| EM Off %, HBM 412 | | 17.6 | 5.87 | 2.93 |
| Power (HBM) 414 | 60 Hz | 101.41% | 100% | 100% |
| Lifetime (HBM) 416 | 60 Hz | 67.65% | 92.40% | 96.50% |

*Fig. 4*

HIGH-BRIGHTNESS MODE ON AN OLED DISPLAY

RELATED APPLICATION

This application claims priority under 35 U.S.C. § 119(e) to U.S. Provisional Patent Application 63/254,934, filed on Oct. 12, 2021 which is incorporated herein by reference in its entirety.

BACKGROUND

Electronic devices often contain organic light emitting diode (OLED) displays, many of which provide multiple brightness levels. To provide a high-brightness mode, many devices implement a display driver integrated circuit (DDIC) to operate the screen at a higher brightness when the device is used in a well-lit area, such as outdoors during the daytime. Some other DDICs, however, do not include a separate high-brightness mode, which limits adjusting of unnecessary display properties that may be imperceptible when the display is operated at a high brightness. As a result, some devices may experience suboptimal battery life and increased lifetime display damage due to burn-in.

SUMMARY

This document describes techniques and apparatuses for a high-brightness mode on an OLED display. The techniques may set a high brightness value in a register of a DDIC associated with the OLED display. In response to determining that the high brightness value has been set in the register of the DDIC, a processor of the electronic device may provide a fewer-pulses command to the DDIC, which adjusts a pulse number to control the OLED display at fewer pulses per period. A new gamma correction may be determined based on the high-brightness value and used to alter content to be presented on the OLED display. As a result, fewer pulses may be used in combination with the second gamma table to provide content on the OLED display at a high brightness.

In aspects, the techniques may be performed to transition between any two brightness values. Further, the techniques may be reversed to transition from a high brightness mode to a normal mode of the OLED display. For example, a normal brightness value may be set in the register of the DDIC. In response, the process may provide a more-pulses command to the DDIC, which adjusts the pulse number to control the OLED display at more pulses per period. A new gamma correction may be determined for the normal brightness and used to provide content on the display at the normal brightness.

In some implementations, the techniques may optimize power consumption and display lifetime by utilizing low-pulse amplitudes, high-pulse durations, and high duty ratios. This may allow for the display to be driven by a low source voltage altered when sending the fewer-pulses command.

Apparatuses are described herein that utilize a computer-readable storage media that, when executed by at least one processor, is configured to perform the techniques for a high-brightness mode on an OLED display. In some implementations, the computer-readable storage media may be included within an integrated circuit, for example, as a system-on-chip (SoC). Alternatively, the computer-readable storage media may be external, but connected, to the processor through a data bus. In this implementation, the computer-readable storage media may be executed by any number of appropriate devices which contain at least one processor.

This Summary is provided to introduce simplified concepts of techniques and apparatuses for high efficiency high brightness mode on an OLED display, the concepts of which are further described below in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of one or more aspects of a high-brightness mode on an OLED display are described below. The use of the same reference numbers in different instances in the description and the figures indicate similar elements:

FIG. 4 illustrates an example performance of a high-efficiency high-brightness mode on an OLED display.

DETAILED DESCRIPTION

Overview

This document describes techniques and apparatuses for a high-brightness mode on an OLED display. Electronic devices generally contain multiple brightness levels to provide visible content to a user through a display. Many electronic devices utilize DDICs to perform pulse width modulation (PWM) at a specified frequency to control display brightness. However, some DDICs fail to exploit display properties that may improve battery life and display health. For example, electronic devices may provide a high-brightness mode to adequately display content to users even in the most illuminated surroundings. In these settings, a lower electromagnetic (EM) frequency may be used to drive the display without a perceivable difference in smoothness to the content viewer. Many DDICs, however, utilize a single register value, which limits the ability to adjust the number of pulses per period for performing PWM. As a result, OLED displays may be driven with short pulses at a high amplitude to achieve high brightness. Over time, short pulses which utilize high current may increase power consumption and cause burn-in, which damages the individual pixels of an OLED display over time.

To overcome this limitation, this document describes techniques and apparatuses for a high-efficiency high-brightness mode on an OLED display. The techniques and apparatuses may set a high-brightness value in a register of a DDIC associated with the OLED display of an electronic device. The electronic device may provide a fewer-pulses command through a processor to adjust a pulse number to control the OLED display at fewer pulses per period. To produce content on the display with appropriate brightness difference, a new gamma correction may be determined for the high-brightness mode. In some aspects, the fewer pulses may utilize a longer pulse duration and lower amplitude when compared to the multiple-pulse implementation of providing a high-brightness mode on the OLED display. The use of a longer pulse duration and a low amplitude, may allow the display to be driven by a low source voltage, improving battery life and display lifetime.

In some implementations, the described high-efficiency high-brightness mode on an OLED display may be provided through an SoC. In this regard, an SoC may be used to execute a brightness change command, which determines the appropriate display settings to provide content at a high-brightness mode on an OLED display while limiting display damage and producing optimal battery life. Other implementations may utilize external computer-readable storage media which facilitates data to be executed by a processor through a data interface or bus.

While features and concepts of the described techniques and apparatuses for a high-brightness mode on an OLED display can be implemented in any number of different environments, aspects are described in the context of the following examples.

Example System

Figure 1:
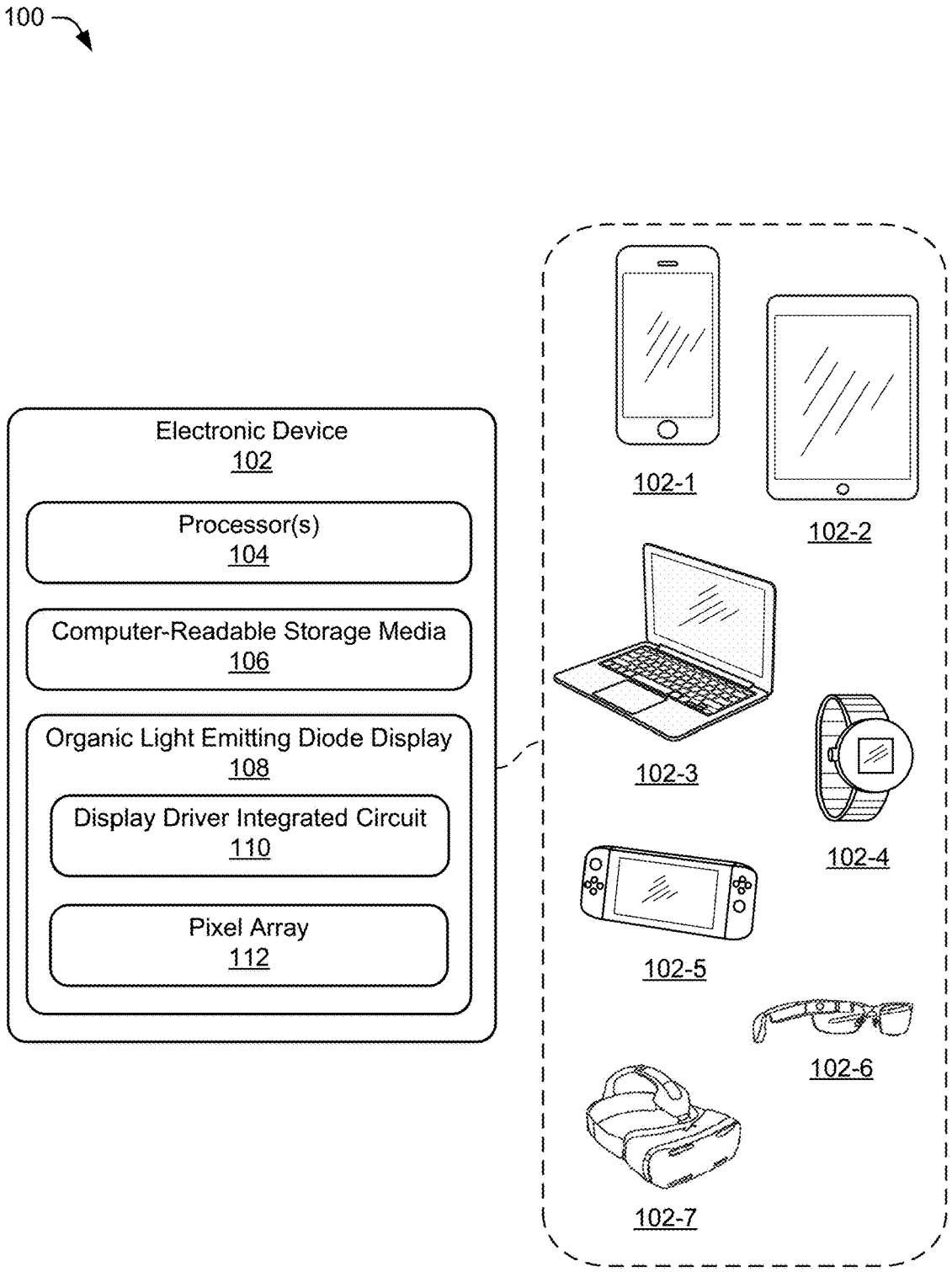
FIG. 1 illustrates an example operating environment for a high-efficiency high-brightness mode on an OLED display.

FIG. 1 illustrates an example 100 operating environment for a high-efficiency high-brightness mode on an OLED display. In the example 100, a high-efficiency high-brightness mode on an OLED display 108 is implemented in an electronic device 102. While displayed in reference to specific devices, the electronic device 102 may be a variety of suitable electronic devices and may include additional components and interfaces omitted from FIG. 1 for the sake of clarity. As non-limiting examples, the electronic device 102 can be a mobile phone 102-1, a tablet device 102-2, a laptop computer 102-3, a computerized watch 102-4, a portable video game console 102-5, smart glasses 102-6, virtual reality goggles 102-7, and the like.

The electronic device 102 includes one or more processors 104 operably connected to a display driver integrated circuit (DDIC) 110. The processor(s) 104 can include, as non-limiting examples, an SoC, an application processor (AP), a central processing unit (CPU), or a graphics processing unit (GPU). The processor(s) 104 generally execute commands and processes utilized by the electronic device 102 and an operating system installed thereon. For example, the processor(s) 104 may perform operations to display graphics of the electronic device 102 on the OLED display 108 and can perform other specific computational tasks, such as controlling the creation and display of an image on the OLED display 108.

The electronic device 102 also includes computer-readable storage media (CRM) 106. The CRM 106 is a suitable storage medium (e.g., random-access memory (RAM), static RAM (SRAM), dynamic RAM (DRAM), non-volatile RAM (NVRAM), read-only memory (ROM), flash memory) configured to store device data of the electronic device 102, user data, and multimedia data. The CRM 106 may store an operating system that generally manages hardware and software resources (e.g., the applications) of the electronic device 102 and provides common services for applications stored on the CRM 106. The operating system and the applications are generally executable by the processor(s) 104 to enable communications and user interaction with the electronic device 102. Further, the CRM 106 may be implemented internal to a processor, for example, in the case of an SoC. Alternatively, or in addition, the CRM 106 may be external to but associated with the processor. Each external memory device storing CRM 106 may communicate data with the processor 104 via a data interface or bus. In some implementations, the CRM 106 may be communicated wirelessly, for example, when stored in a remote server.

The electronic device 102 further includes an OLED display 108. The OLED display 108 includes a pixel array 112 of pixel circuits, which is controlled by DDIC 110. In aspects, the DDIC 110 may act as an interface between the processor 104 and the pixel array 112 to provide content on the OLED display 108. The DDIC 110 may be used to control different elements of the OLED display 108, for example, brightness and color.

Figure 2:
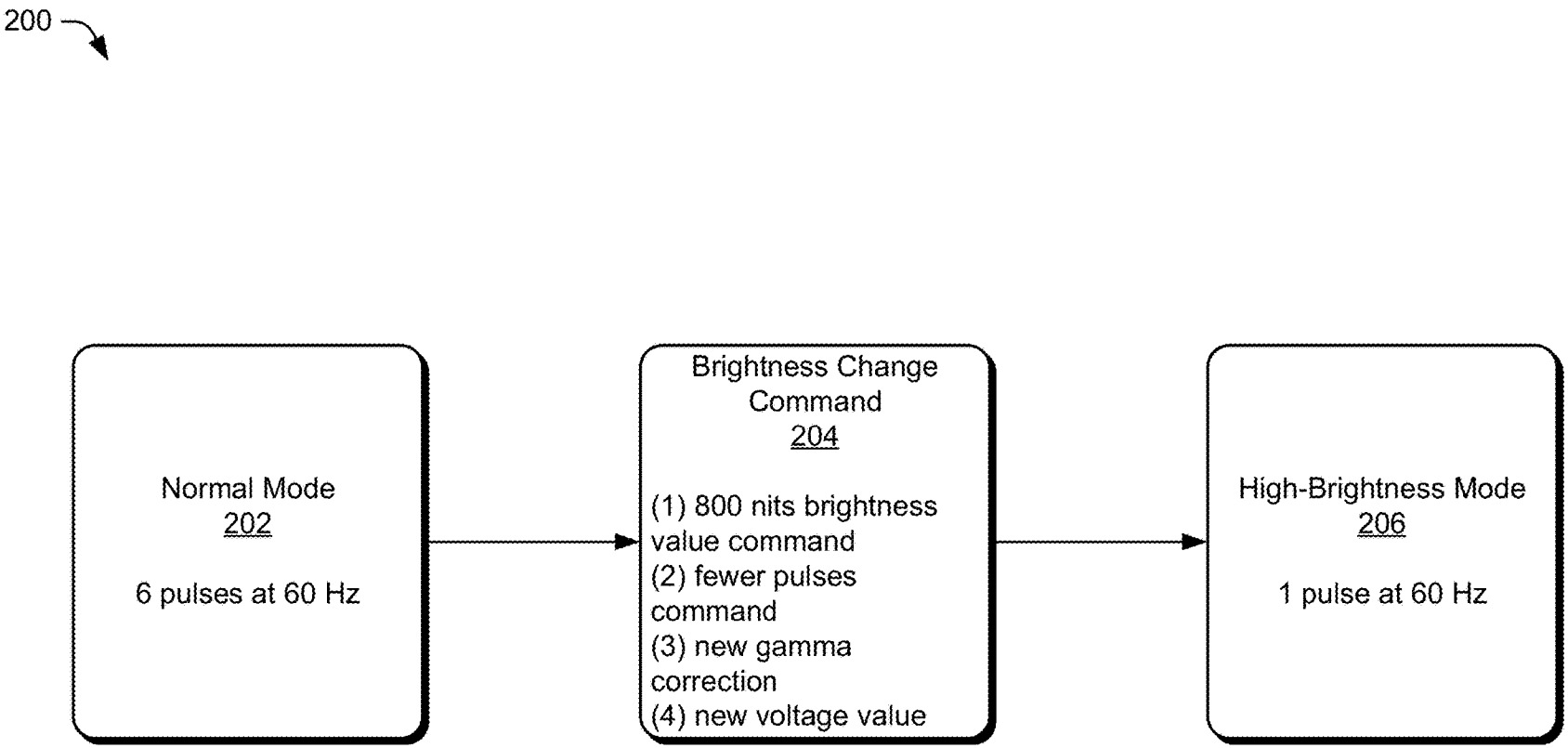
FIG. 2 illustrates an example transformation from a normal mode to a high-efficiency high-brightness mode on an OLED display.

FIG. 2 illustrates an example 200 transformation from a normal mode to a high-efficiency high-brightness mode on an OLED display. In the example 200, an OLED display (e.g., OLED display 108) is operated in a normal mode 202. In some implementations, the normal mode 202 may correspond to a standard operating condition of the OLED display. The normal mode 202 may include various brightness settings, for example, brightness values ranging from 1 nit to 600 nits. Accordingly, the normal mode 202 may be able to provide a suitable range of brightness to view content presented on the OLED display in standard conditions, such as indoors. At each brightness, displays often utilize a gamma correction to provide an accurate brightness difference between content being displayed on the OLED panel. Generally, gamma correction is used to alter a linear brightness value perceived by a sensor to an appropriate brightness value to be perceived by the user, and vice versa. Accordingly, gamma correction may be used to display content with an appropriate linear brightness value, which when perceived by the user, appears natural. In some implementations, the OLED may be operated with a specific gamma correction for all brightness values in the normal mode 202. In other implementations, a gamma correction may be calculated for each brightness value, as changes in brightness may change the appropriate gamma correction to accurately perceive the brightness difference between content presented on the OLED display. Further, the normal mode 202 may require the OLED display to be driven at a high electromagnetic (EM) frequency to provide a smooth display void of display artifacts. As illustrated, the normal mode 202 drives the OLED display with six pulses at a frequency of 60 Hz which corresponds to an EM frequency of 360 Hz. In conditions suitable for the normal mode 202, this EM frequency may provide smooth, non-pulsating content to a viewer of the OLED display.

Situations exist where the OLED display is used within a highly illuminated area, for example, outdoors during the daytime. To provide adequate visibility to a user viewing content on the OLED display, the display may be required to operate at a higher brightness. In some implementations, the OLED display contains a high-brightness mode 206 with a corresponding brightness value or range of brightness values. At high brightness values such as these, a viewer of the OLED display may not perceive a brightness or smoothness difference between an EM frequency of 60 Hz and a higher EM frequency of 90 or 120 Hz. Thus, providing a high EM frequency when the display is operated at a high-brightness value may burden the display yet provide little benefit to the viewer. Many DDICs, however, do not contain separate registers/modes to operate the display in normal mode 202 or high-brightness mode 206. This limitation may force the display to be driven at a same EM frequency as in normal mode 202, which may consequently waste power and cause damage to the OLED display over time due to burn-in.

To overcome the DDIC limitation, a brightness change command 204 can be sent by a processor (e.g., processor 104) of an electronic device (e.g., electronic device 102) containing the OLED display to alter the display properties when the OLED display is operated in the high-brightness mode 206. In one example, a display brightness value of 800 nits is set in a brightness value register of the DDIC. As a result, the processor sends the fewer-pulses command to adjust the display to be driven by fewer pulses at a same operating frequency (e.g., 60 Hz). Responsive to the brightness change, the fewer-pulses command may trigger the determination of a new gamma correction for the new brightness value of 800 nits. In some implementations, the gamma correction may be determined by the processor based on a difference between the brightness value in the normal mode 202 and the brightness value in the high-brightness mode 206. Alternatively, or in addition, the new gamma correction for the high-brightness mode 206 may be a compensated curve of the previous gamma correction of the normal mode 202. In aspects, the use of fewer pulses when the OLED display is operated in high-brightness mode 206 may allow for the source voltage (ELVSS) to be lowered. Accordingly, the source voltage driving the display may be changed to a minimum voltage as part of the brightness change command 204, thus lowering the overall power consumption. In some implementations, the brightness change command 204 is stored in an SoC and executed right before the OLED display enters high-brightness mode 206.

The OLED display may enter high-brightness mode 206 in response to the brightness change command 204. In the high-brightness mode 206, the OLED display may provide content at the new brightness when driven at fewer pulses at a same frequency as the normal mode 202, for example, one pulse at 60 Hz as illustrated. It should be noted that while the process is shown as a transformation from the normal mode 202 to the high-brightness mode 206, the process is applicable in either direction. Specifically, the brightness change command 204 may be executed immediately before exiting high-brightness mode 206 to transition the display to normal mode 202. In this implementation, the fewer-pulses command is replaced with a more-pulses command, where the display is driven at a same frequency with more pulses per period. For example, the display may operate in the high brightness mode 206 when a display brightness register within the DDIC is set to 200 nits. The brightness change command 204 may execute the more-pulses command, determine a new gamma correction for the 200 nit brightness value, and determine the appropriate source voltage. In response, the OLED display may provide content at the new brightness when driven by more pulses at the same frequency as the high brightness mode 206. For example, the display may again be driven by six pulses at 60 Hz in the normal mode 202.

Figure 3:
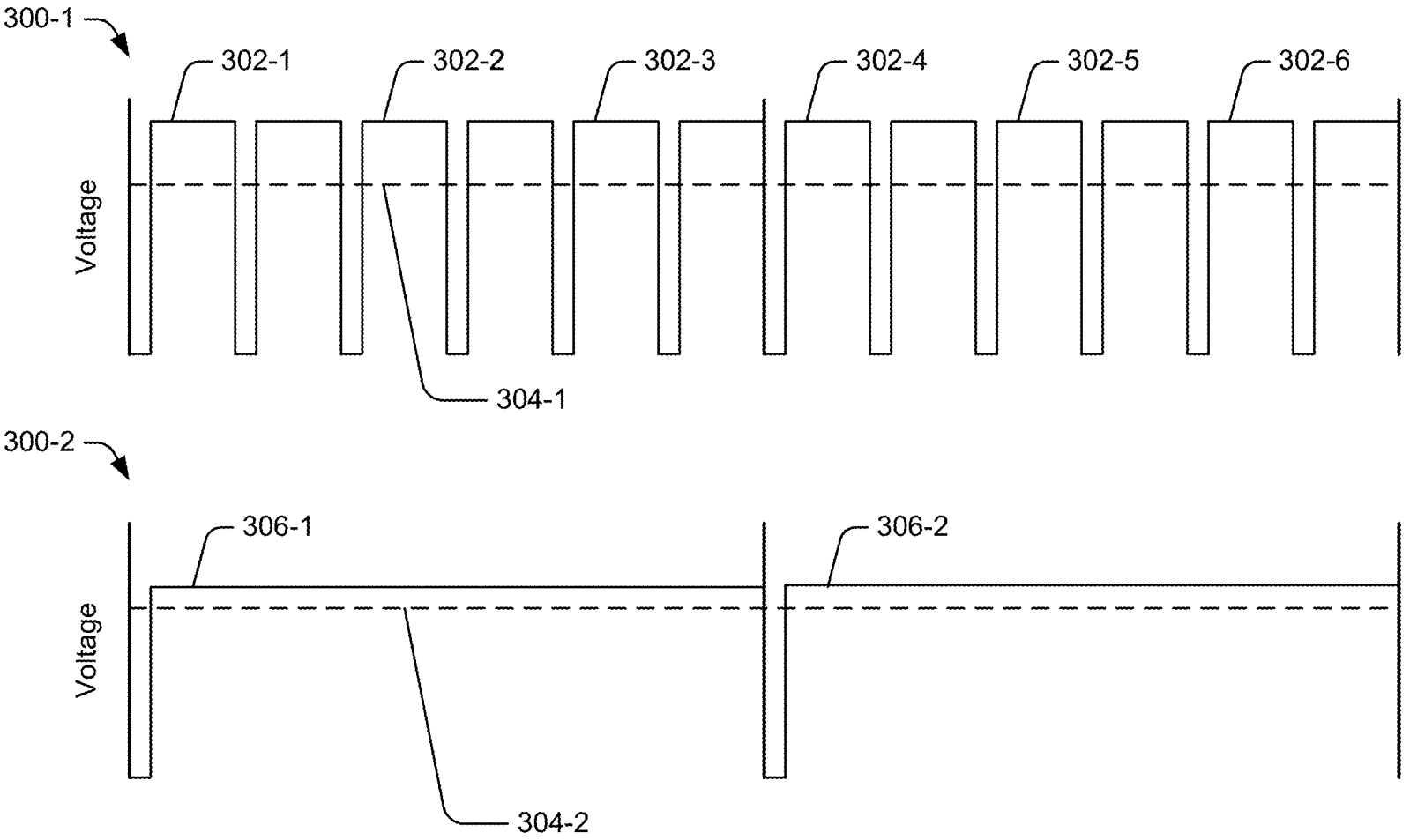
FIG. 3 illustrates an example high-brightness mode in comparison to an example high-efficiency high-brightness mode on an OLED display.

FIG. 3 illustrates an example 300-1 high-brightness mode in comparison to an example 300-2 high-efficiency high-brightness mode. In both examples, PWM is used to adjust the brightness of the OLED display. A pulse 302 (e.g., pulse 302-1, pulse 302-2, pulse 302-3, pulse 302-4, pulse 302-5, pulse 302-6) or pulse 306 (e.g., pulse 306-1 and 306-2) is defined as a time when the voltage is in an on state. Alternatively, the display may be off when the voltage is in an off state (e.g., in between the pulses 302). Take the example 300-1 where the display is driven at six pulses 302 per period and each pulse 302 has a relatively short duration and a high amplitude. As a result, the display cycles between an on and off setting producing quick, high-current pulses 302, which must be driven by a high source voltage. For each period, an average voltage 304-1 may be determined by summing the pulses 302 per period and dividing by the period. The average voltage 304-1 may measure the brightness of the display, thus, the quick, high-current pulses 302 average to produce an appropriately high brightness. However, the pulses 302 require a high source voltage, which require more power and may adversely affect battery life. Additionally, the abrupt, high-current pulses 302 may cause large amounts of energy at each pixel of the display. In some instances, this energy may cause individual pixels to burn in and over time, damage the display. It should be noted that the example 300-1 illustrates two identical periods of PWM for the high-brightness mode.

The example 300-2, however, illustrates a high-efficiency high-brightness mode on an OLED display. In this example, the display is driven by a single pulse per period. Compared to the pulses 302 of example 300-1, the pulses 306 in example 300-2 have a relatively long duration, and the amplitude of each of the pulses 306 is low. This allows for the display driven by example 300-2 to experience very little time in the off state. Further, the low-current pulses 306 allow for use of a lower source voltage to drive the display. Thus, even though the pulses 306 have a comparably lesser amplitude, the greater time spent in the on state produces a same or similar average voltage 304-2. As a result, the example 300-2 may produce a same or similar screen brightness as the example 300-1. Further, the example 300-2 may result in a higher display lifespan and a lower power consumption. For example, the lower amplitude of the pulses 306 may allow the display to be driven by a lower source voltage and, thus, reduce power consumption. Further, the lesser current and longer pulse duration may lessen the likelihood of pixel damage due to burn-in as the instantaneous energy created at each pixel is reduced. Similar to the example 300-1, the example 300-2 illustrates two identical periods of PWM for the high efficiency high brightness mode.

Example Results

FIG. 4 illustrates example 400 performance of a high-efficiency high-brightness mode on an OLED display. Specifically, the example 400 illustrates three implementations for providing a high brightness mode 410 on an OLED display. A baseline 402 represents the results of providing the high brightness mode 410 with a same electromagnetic (EM) frequency as used in a normal mode 408, as illustrated, 360 Hz. An option 404 illustrates the results of providing the high-brightness mode 410 with an EM frequency one third the EM frequency used in a normal mode (e.g., 120 Hz). Additionally, option 406 is illustrated which uses a pulse number of one pulse to provide the high-brightness mode 410. Each implementation operates the display in normal mode 408 in one of two configurations, a frequency of 120 Hz and a frequency of 60 Hz. At 120 Hz, the pulse number is three pulses while at 60 Hz, the pulse number is six pulses. As a result, both implementations produce an EM frequency of 360 Hz. Similarly, each implementation operates the display in high-brightness mode 410 through one of two configurations. The baseline 402 operates with a pulse number of three at 120 Hz and six at 60 Hz to maintain an EM frequency of 360 Hz. The option 404 operates at one pulse for 120 Hz and two pulses for 60 Hz to maintain an EM frequency of 120 Hz in both configurations. In contrast to the baseline 402 and option 404, option 406 operates at a different EM frequency for the 120 Hz and 60 Hz configurations. Specifically, option 406 operates at one pulse for a first and second configurations to produce an EM frequency of 120 Hz and 60 Hz, respectively.

The example 400 further illustrates an EM off percentage 412 which measures the percentage of time that the display is in the off state, for example, in between pulses. The example 400 also provides the result of each implementation with respect to power consumption 414 and display lifetime 416. With regard to the baseline 402, the EM off percentage 412 is 17.6%. As a result, the baseline 402 may use short-duration, high-amplitude pulses to achieve the high-brightness mode 410, which may cause suboptimal power consumption and display damage, as shown by the power consumption 414 of 101.41% and the display lifetime 416 of 67.65%.

Option 404 may provide an improvement over the baseline 402. For example, the option 404 utilizes a single pulse at 120 Hz to provide the high-brightness mode 410, which results in an EM off time of 0.489 milliseconds (ms) per period. In the other configuration, the option 404 utilizes two pulses at 60 Hz and an EM off time of 0.978 ms per period. In both configurations, the EM off percentage 412 is equal to 5.87%. Compared to the baseline 402, option 404 is operated in the on state for a greater percentage of time, which may allow for longer-duration, lower-amplitude pulses. As a result, the example 400 illustrates a perfect power consumption 414 of 100% and an improved display lifetime 416 of 92.40%.

The option 406, however, is shown to produce the best results. Specifically, option 406 utilizes a single pulse to produce the high brightness mode 410 for each of the 120 Hz and 60 Hz configurations. In the 120 Hz configuration, the EM off time is shown to be 0.2445 ms while the EM off time of the 60 Hz configuration is shown as 0.489 ms. For both implementations, this corresponds to an EM off percentage 412 of 2.93%. Thus, option 406 utilizes a lower EM off percentage 412 than both of option 404 and the baseline 402. Accordingly, the option 406 may utilize the longest-duration, lowest-amplitude pulses to provide the high-brightness mode 410. As shown, this may produce optimal power consumption 414 of 100% and improved display lifetime 416 of 96.50%. While shown in reference to specific frequencies, it should be appreciated that the display may be driven at any number of frequencies and any number of pulse numbers.

Example Methods

Figure 5:
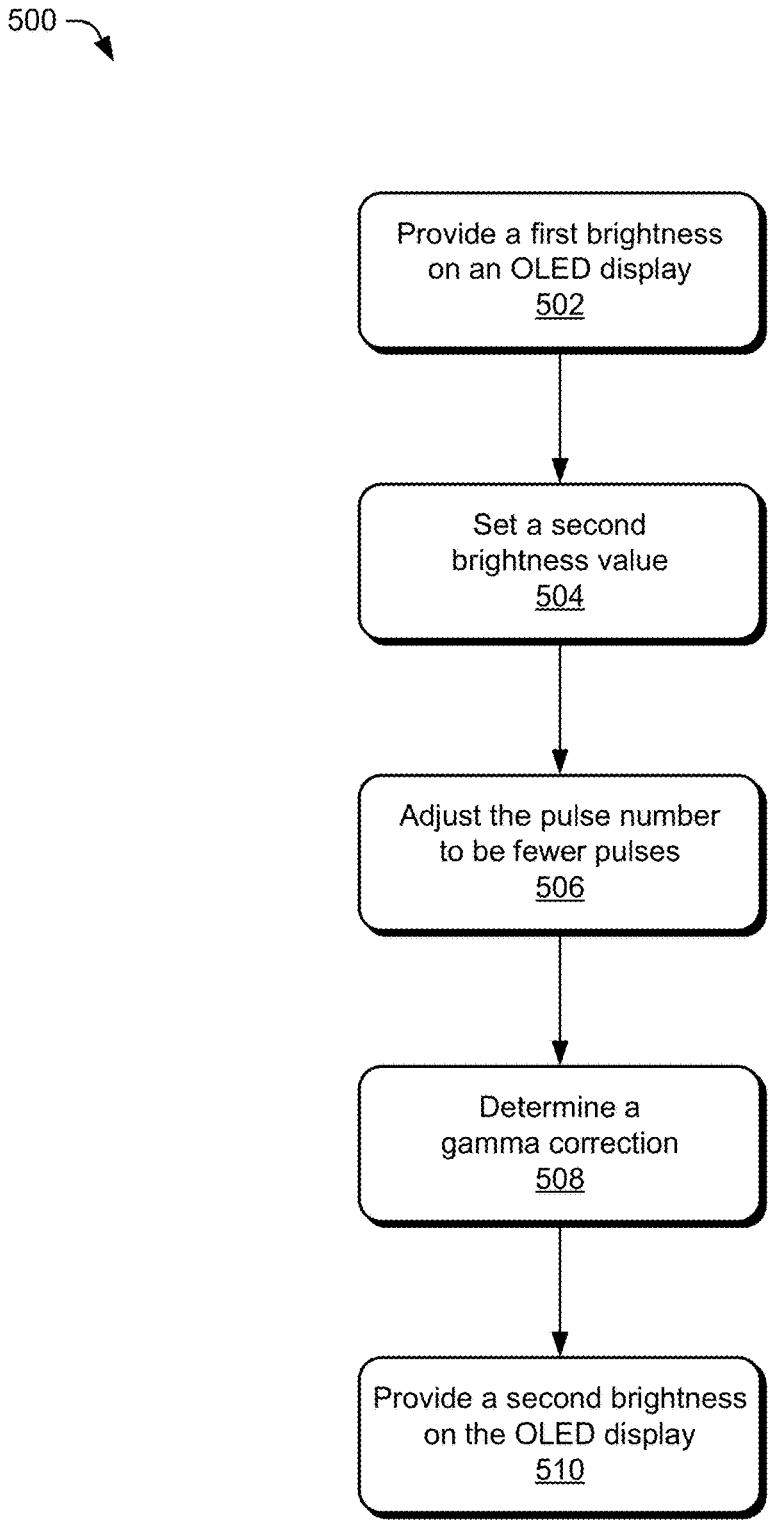
FIG. 5 illustrates an example method for providing a high-efficiency high-brightness mode on an OLED display.

FIG. 5 illustrates an example 500 method for providing a high-efficiency high-brightness mode on an OLED display. At 502, an electronic device provides content on an OLED display at a first brightness. In some aspects, the first brightness may include a corresponding brightness value set in a register of a DDIC associated with the OLED display. In some implementations, the DDIC may contain only one brightness value register to be used when operating the display in normal mode or high-brightness mode. The register of a DDIC may be set through user interaction, for example, user interaction with a touch panel and corresponding brightness setting on the OLED display. In other aspects, the brightness setting may be set automatically in response to sensor data (e.g., a brightness sensor). The first brightness may correspond to a normal mode and include the use of PWM to control brightness. In normal mode, PWM may be performed with a sufficiently fast EM frequency to provide a smooth display free of display artifacts.

At 504, a second brightness value may be set within the register of the DDIC associated with the OLED. In aspects, the second brightness value is higher than the corresponding first brightness value. In some implementations, the second brightness value may be implemented through a high-brightness mode. In aspects, a high-brightness mode is triggered when a brightness value is set which exceeds a predetermined threshold. In some implementations, the normal mode and high brightness-mode may contain a range of brightness values to be provided within each of the modes. Like in 502, the second brightness value may be set through user interaction, in response to sensor data, or any other appropriate method.

At 506, a pulse number is adjusted to be fewer pulses per period. For example, PWM may be used to provide the first brightness at 502 by driving the display with more pulses at a specific frequency, for example, six pulses at 60 Hz. In some implementations the first brightness may be provided with a specific EM frequency, in this example, 360 Hz. To provide a high-brightness mode, the pulse number may be adjusted to fewer pulses per period, thus, altering the EM frequency. In some implementations, this is done as part of a brightness change command. This command may be performed by a processor of the electronic device to overcome the limitations of the DDIC. In some implementations, this command may be stored and performed by an SoC of the electronic device. Further, the use of fewer pulses may increase the EM off time per period and allow a low-amplitude, long-duration pulse to be used to drive the display. In some aspects, this may reduce the power consumption and display damage caused by operating the display.

At 508, a gamma correction is determined for the second brightness value. A gamma correction may be used to display content on the screen with an appropriate brightness differential. In some implementations, the display uses a different gamma correction for each brightness. In other implementations, a first gamma correction is used for all brightness values corresponding to the normal mode and a second gamma correction is used for all brightness values corresponding to the high-brightness mode. The second gamma correction may be determined by altering a first gamma correction used to provide the first brightness on the OLED display. In this regard, the second gamma correction may be a compensate curve of the first gamma correction based on the difference in the first and second brightness value. In some aspects, the first and second gamma corrections may be implemented in a lookup table, which alters data values to provide appropriate brightness output on the OLED display. The second gamma correction may be used when the OLED display provides content at the second brightness.

At 510, the OLED display provides content at the second brightness. In some aspects, the display provides content at the second brightness through a high-brightness mode, while in other aspects, the second brightness corresponds to an additional brightness value within the normal mode. The OLED display may be driven at fewer pulses per period when providing the content in the second brightness. In some implementations, this may allow the source voltage used to drive the display to be lowered. Accordingly, the brightness change command may include a determination and change to a lower source voltage.

Although aspects of the above method have been described in the direction of changing an OLED display from a normal mode to a high-brightness mode, the described method may be similarly performed to transform a display from a high-brightness mode to a normal mode. For example, the brightness change command may be executed immediately before entering high-brightness mode, or immediately before exiting high-brightness mode. In the latter, the brightness change command may include the more-pulses command where the display is driven by more pulses at a specific frequency. Accordingly, the methods described herein may allow an OLED display to provide a high-efficiency high-brightness mode.

Generally, any of the components, modules, methods, and operations described herein can be implemented using software, firmware, hardware (e.g., fixed logic circuitry), manual processing, or any combination thereof. Some operations of the example methods may be described in the general context of executable instructions stored on computer-readable storage memory that is local and/or remote to a computer processing system, and implementations can include software applications, programs, functions, and the like. Alternatively or in addition, any of the functionality described herein can be performed, at least in part, by one or more hardware logic components, including, and without limitation, Field-programmable Gate Arrays (FPGAs), Application-specific Integrated Circuits (ASICs), Application-specific Standard Products (ASSPs), System-on-a-chip systems (SoCs), Complex Programmable Logic Devices (CPLDs), and the like.

Conclusion

Although aspects of a high-brightness mode for an OLED display have been described in language specific to features and/or methods, the subject of the appended claims is not necessarily limited to the specific features or methods described. Rather, the specific features and methods are disclosed as example implementations of the claimed high-brightness mode for an OLED display, and other equivalent features and methods are intended to be within the scope of the appended claims. Further, various aspects are described, and it is to be appreciated that each described aspect can be implemented independently or in connection with one or more other described aspects.

What is claimed is:

1. A method for controlling screen brightness on an organic light emitting diode (OLED) display, the method comprising:

setting a first display brightness value at only one brightness value register within a display driver integrated circuit (DDIC) associated with the OLED display;

providing, in accordance with the first display brightness value, a first brightness on the OLED display by:

driving the OLED display at a first frequency, two or more pulses, and a first gamma correction set;

transmitting, by at least one processor separate from the DDIC, a command to reduce a number of pulses at the DDIC;

replacing, based on the command by the at least one processor separate from the DDIC to reduce the number of pulses at the DDIC, the first display brightness value with a second display brightness value in the brightness value register, the second display brightness value greater than the first display brightness value; and providing, in accordance with the second display brightness value, a second brightness on the OLED display by:

adjusting, at the DDIC, to fewer pulses based on the command to reduce the number of pulses; and driving the OLED display at the first frequency, the fewer pulses, and a second gamma correction set.

2. The method of claim 1, wherein providing the second brightness on the OLED display further comprises:

using a first supply voltage lower than a second supply voltage, the second supply voltage equal to a required voltage needed to provide the second brightness on the OLED display by driving the OLED display at more pulses than the fewer pulses.

3. The method of claim 1, further comprising:

setting a third display brightness value within the DDIC associated with the OLED display, the third display brightness value less than the second display brightness value; and providing, in accordance with the third display brightness value, a third brightness on the OLED display by:

adjusting, by the at least one processor separate from the DDIC, the fewer pulses to be more pulses than the fewer pulses; and driving the OLED display at the first frequency, the more pulses, and a third gamma correction set.

4. The method of claim 3, wherein providing the third brightness on the OLED display further comprises:

determining the third gamma correction set for the third display brightness value.

5. The method of claim 1, wherein the fewer pulses is one pulse.

6. The method of claim 1, wherein providing the second brightness on the OLED display by driving the OLED display at the fewer pulses further comprises:

using a first pulse duration longer than a second pulse duration, the second pulse duration equal to a required pulse duration needed to provide the second brightness on the OLED display by driving the OLED display at more pulses than the fewer pulses; and using a first pulse amplitude smaller than a second pulse amplitude, the second pulse amplitude equal to a required pulse amplitude needed to provide the second brightness on the OLED display by driving the OLED display at more pulses than the fewer pulses.

7. A The method as in of claim 6, wherein providing the second brightness on the OLED display by driving the OLED display at the fewer pulses further comprises:

using a first duty ratio higher than a second duty ratio, the second duty ratio equal to a required duty ratio used to provide the second brightness on the OLED display by driving the OLED display at more pulses than the fewer pulses.

8. The method of claim 1, wherein the at least one processor is a system-on-chip (SoC).

9. The method of claim 1, wherein providing the second display brightness on the OLED display further comprises:

determining the second gamma correction set for the second display brightness value.

10. The method of claim 1, further comprising:

determining that an ambient light surrounding the OLED display exceeds a threshold brightness, and wherein transmitting the command to reduce the number of pulses at the DDIC is based on the determination that the ambient light surrounding the OLED display exceeds the threshold brightness.

11. A system for controlling screen brightness on an organic light emitting diode (OLED) display, the system comprising:

a display driver integrated circuit (DDIC) associated with the OLED display, the DDIC having only one brightness value register;

at least one processor separate from the DDIC; and a computer-readable storage media that when executed by the at least one processor is configured to:

set a first display brightness value at the brightness value register within the DDIC;

provide, in accordance with the first display brightness value, a first brightness on the OLED display by:

driving the OLED display at a first frequency, two or more pulses, and a first gamma correction set;

transmit, by the at least one processor separate from the DDIC, a command to reduce a number of pulses at the DDIC;

replace, based on the command by the at least one processor separate from the DDIC to reduce the number of pulses at the DDIC, the first display brightness value with a second display brightness value in the brightness value register, the second display brightness value greater than the first display brightness value; and provide, in accordance with the second display brightness value, a second brightness on the OLED display by:

adjusting, at the DDIC, to fewer pulses based on the command to reduce the number of pulses; and driving the OLED display at the first frequency, the fewer pulses, and a second gamma correction set.

12. The system of claim 11, wherein providing the second brightness on the OLED display further comprises:

using a first supply voltage lower than a second supply voltage, the second supply voltage equal to a required voltage needed to provide the second brightness on the OLED display by driving the OLED display at more pulses than the fewer pulses.

13. The system of claim 11, wherein the computer-readable storage media, when executed by the at least one processor, is further configured to:

set a third display brightness value within the DDIC associated with the OLED display, the third display brightness value less than the second display brightness value; and provide, in accordance with the third display brightness value, a third brightness on the OLED display by:

adjusting, by the at least one processor separate from the DDIC, the fewer pulses to be more pulses than the fewer pulses; and driving the OLED display at the first frequency, the more pulses, and a third gamma correction set.

14. The system of claim 13, wherein providing the third brightness on the OLED display further comprises:

determining the third gamma correction set for the third display brightness value.

15. The system of claim 11, wherein the fewer pulses is one pulse.

16. The system of claim 11, wherein providing the second brightness on the OLED display by driving the OLED display at the fewer pulses further comprises:

using a first pulse duration longer than a second pulse duration, the second pulse duration equal to a required pulse duration needed to provide the second brightness on the OLED display by driving the OLED display at more pulses than the fewer pulses; and using a first pulse amplitude smaller than a second pulse amplitude, the second pulse amplitude equal to a required pulse amplitude needed to provide the second brightness on the OLED display by driving the OLED display at more pulses than the fewer pulses.

17. The system of claim 16, wherein providing the second brightness on the OLED display by driving the OLED display at the fewer pulses further comprises:

using a first duty ratio higher than a second duty ratio, the second duty ratio equal to a required duty ratio used to provide the second brightness on the OLED display by driving the OLED display at more pulses than the fewer pulses.

18. The system of claim 11, wherein the at least one processor is a system-on-chip (SoC).

19. The system of claim 11, wherein providing the second display brightness on the OLED display further comprises:

determining the second gamma correction set for the second display brightness value.

20. The system of claim 11, wherein the computer-readable storage media that when executed by the at least one processor is further configured to:

determine that an ambient light surrounding the OLED display exceeds a threshold brightness, and wherein the transmission of the command to reduce the number of pulses at the DDIC is based on the determination that the ambient light surrounding the OLED display exceeds the threshold brightness.

* * * * *